US008621893B2

(12) United States Patent
Ko et al.

(10) Patent No.: US 8,621,893 B2
(45) Date of Patent: Jan. 7, 2014

(54) WASHING MACHINE AND METHOD OF CONTROLLING THE SAME

(75) Inventors: Hong Seok Ko, Yongin-si (KR); Seung Ju Choi, Seoul (KR); Gyu Sung Na, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 847 days.

(21) Appl. No.: 11/902,942

(22) Filed: Sep. 26, 2007

(65) Prior Publication Data

US 2008/0105002 A1 May 8, 2008

(30) Foreign Application Priority Data

Nov. 6, 2006 (KR) ..... 10-2006-0108949

(51) Int. Cl.

| | |
|---|---|
| ***D06F 33/02*** | (2006.01) |
| ***D06F 37/30*** | (2006.01) |
| ***H02P 1/00*** | (2006.01) |

(52) U.S. Cl.

USPC ..... 68/12.06; 68/3 R; 68/23.1; 68/23.2; 8/158; 8/159

(58) Field of Classification Search

USPC ..... 8/158, 159; 68/3 R, 12.06, 23.1, 23.2
See application file for complete search history.

(56) References Cited

U.S. PATENT DOCUMENTS

| | | | | |
|---|---|---|---|---|
| 5,850,749 | A * | 12/1998 | Kim | 68/23.2 |
| 5,916,274 | A * | 6/1999 | Lee et al. | 68/23.2 |
| 6,082,151 | A * | 7/2000 | Wierzba et al. | 68/23.2 |
| 6,578,225 | B2 * | 6/2003 | Jonsson | 8/159 |
| 6,647,575 | B2 * | 11/2003 | Garstecki et al. | 8/159 |
| 2005/0274159 | A1 * | 12/2005 | Jeon et al. | 68/23.1 |

FOREIGN PATENT DOCUMENTS

| | | |
|---|---|---|
| EP | 0924330 A1 | 6/1999 |
| KR | 10-1998-067196 | 10/1998 |
| KR | 1999-0038279 | 6/1999 |

OTHER PUBLICATIONS

Machine Translation of EP 0924330 to Beier et al., Jun. 1990.*
Chinese Office Action for corresponding Chinese Patent Application No. 2007101624835 dated Jun. 26, 2009 (6 pgs).

* cited by examiner

*Primary Examiner* — Michael Barr
*Assistant Examiner* — Benjamin L Osterhout
(74) *Attorney, Agent, or Firm* — Staas & Halsey LLP

(57) ABSTRACT

A washing machine having balancers and a method of controlling the same is provided. The number of rotations of a motor is maintained at a designated number before excessive vibration of a tub occurs for a designated time in order to prevent excessive vibration of the tub before balls reach a balancing position. The method includes sensing the number of rotations of a motor; determining whether or not the sensed number of rotations of the motor reaches a designated number of rotations by comparing the sensed number of rotations of the motor with the designated number of rotations; and controlling the motor such that the number of rotations of the motor is maintained at the designated number of rotations when it is determined that the sensed number of rotations of the motor reaches the designated number of rotations.

6 Claims, 8 Drawing Sheets

WASHING MACHINE AND METHOD OF CONTROLLING THE SAME

CROSS-REFERENCE TO RELATED APPLICATIONS

This application claims the benefit of Korean Patent Application No. 2006-0108949, filed Nov. 6, 2006, in the Korean Intellectual Property Office, the disclosure of which is incorporated herein by reference.

BACKGROUND

1. Field

The present invention relates to a washing machine having balancers, and more particularly, to a washing machine, which reduces the vibration of a tub generated by the partial disposition of laundry in a dehydrating operation, and a method of controlling the same.

2. Description of the Related Art

Generally, washing machines, usually drum washing machines, are apparatuses that wash laundry by power generated when laundry is lifted and then dropped. A conventional drum washing machine includes a tub installed in a housing, which forms the external appearance of the washing machine, to contain water, a drum rotatably installed in the tub containing laundry, and a motor generating a driving force for rotating the drum.

In such a drum washing machine, when the drum is rotated at a high speed in a dehydrating operation under a condition that the laundry is not uniformly distributed in the drum, but is clustered on a specific part of the drum, the drum is eccentrically rotated on a rotary shaft and collides with the tub, thus generating vibration and noise. When repeated, parts of the washing machine including the drum and the tub are out of order or life spans of the parts are shortened.

In order to solve the above problems, Korean Patent Laid-Open Publication No. 1999-0038279 discloses a washing machine having balancers, which are provided on front and rear ends of a drum so as to reduce the vibration of a tub caused by the eccentric rotation of the drum.

Each of the balancers of the washing machine disclosed by the above Publication comprises a race installed on the front or rear end of the drum maintaining the dynamic balance of the drum when the drum is rotated at a high speed, balls made of steel and installed in the races such that they can move freely, and a viscous oil filling the inside of the race for adjusting the momentum of the balls. The race is formed by bonding ring-shaped upper and lower plates.

Therefore, when the drum is rotated under a condition that the drum cannot maintain its dynamic balance due to the unbalanced eccentric structure of the drum and the partial disposition of laundry in the drum, the balls made of steel compensate for the imbalance of the drum, thus allowing the drum to maintain the dynamic balance.

Each of the balancers of the conventional washing machine has a multi-race including at least two race parts, an inner race part and an outer race part, preventing the excessive vibration of the tub generated when the balls reach a balancing position, and the viscous oils having different viscosities and the balls having different sizes respectively filling the race parts, thus having high production costs. Further, the constitution of the races preventing the excessive vibration of the tub is not determined by precise calculation, but only reduces the probability of the vibration of the tub. Thus, the possibility of generating excessive vibration of the tub still remains.

Accordingly, in order to further reduce the probability of the excessive vibration of the tub, a larger number of race parts are required.

SUMMARY

Therefore, one aspect of the invention is to provide a washing machine having balancers and a method of controlling the same, in which the number of rotations of a motor is maintained to a designated number of rotations, before the excessive vibration of a tub occurs, for a designated time until balls in the balancers reach a balancing position in order to prevent the excessive vibration of the tub before the balls reach the balancing position, thus reducing the excessive vibration of the tub.

Another aspect of the invention is to provide a washing machine having balancers and a method of controlling the same, in which the number of rotations of a motor is maintained to a designated number of rotations, before the excessive vibration of a tub occurs, for a designated time so as to pass a point, at which the excessive vibration of the tub occurs, each of the balancers employing a single race, instead of a multi-race, so as to reduce production costs, and the excessive vibration of the tub is prevented by a control operation, instead of a probability, so as to effectively reduce the excessive vibration of the tub.

Additional aspects and/or advantages will be set forth in part in the description which follows and, in part, will be apparent from the description, or may be learned by practice of the invention.

The foregoing and/or other aspect, are achieved by providing a method of controlling a washing machine having balancers, comprising: sensing a rotational speed of a motor; determining whether or not the sensed rotational speed of the motor reaches a designated rotational speed comprising comparing the sensed rotational speed of the motor with the designated rotational speed; and controlling the motor such that the rotational speed of the motor is maintained at the designated rotational speed when it is determined that the sensed rotational speed of the motor reaches the designated rotational speed.

The sensing of the number of rotations of the motor comprises sensing the number of rotations of the motor driven for performing a dehydrating operation of the washing machine.

The designated number of rotations is lower than a number of rotations generating the excessive vibration of the tub in a dehydrating operation.

The number of rotations generating the excessive vibration of the tub is the number of rotations of the motor at a point, at which the tub is excessively vibrated due to a difference of rotational speeds between a drum and balls in the balancers before the balls reach a balancing position.

The controlling of the motor such that the number of rotations of the motor is maintained to the designated number of rotations comprises maintaining the number of rotations of the motor to a designated number of rotations prior to at a point, at which the tub is excessively vibrated, generated in a dehydrating operation of the washing machine so as to pass the point.

The method may further comprise increasing the number of rotations of the motor, after the controlling of the motor such that the number of rotations of the motor is maintained to the designated number of rotations.

The increasing of the number of rotations of the motor comprises maintaining the number of rotations of the motor to the designated number of rotations for a designated time, and then increasing the number of rotations of the motor to a dehydrating rpm for performing a dehydrating operation.

The increasing of the number of rotations of the motor comprises increasing the number of rotations of the motor to a dehydrating rpm for performing a dehydrating operation by checking a variation of the vibration of the tub due to a difference of rotational speeds between a drum and balls in the balancers while the number of rotations of the motor is maintained to the designated number of rotations.

The foregoing and/or other aspects are also achieved by providing a washing machine, comprising: a motor; a plurality of balancers; a number sensing unit sensing the number of rotations of the motor per minute; and a control unit comparing the sensed number of rotations of the motor per minute with a designated rotational speed per minute, and controlling the motor such that the number of rotations of the motor is maintained at the designated rotational speed when the sensed rotational speed of the motor reaches the designated rotational speed.

The number sensing unit senses the number of rotations of the motor driven for performing a dehydrating operation of the washing machine.

The designated number of rotations is predetermined to be lower than a number of rotations generating the excessive vibration of the tub in a dehydrating operation of the washing machine, by the control unit.

The number of rotations generating the excessive vibration of the tub is the number of rotations of the motor at a point, at which the tub is excessively vibrated due to a difference of rotational speeds between a drum and balls in the balancers before the balls reach a balancing position.

The control unit controls the motor such that the number of rotations of the motor is maintained to a designated number of rotations prior to at a point, at which the tub is excessively vibrated, generated in a dehydrating operation of the washing machine so as to pass the point.

The control unit maintains the number of rotations of the motor to the designated number of rotations for a designated time, and then increases the number of rotations of the motor to a dehydrating rpm for performing a dehydrating operation.

The control unit increases the number of rotations of the motor to a dehydrating rpm for performing a dehydrating operation by checking a variation of the vibration of the tub due to a difference of rotational speeds between a drum and balls in the balancers while the number of rotations of the motor is maintained to the designated number of rotations.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
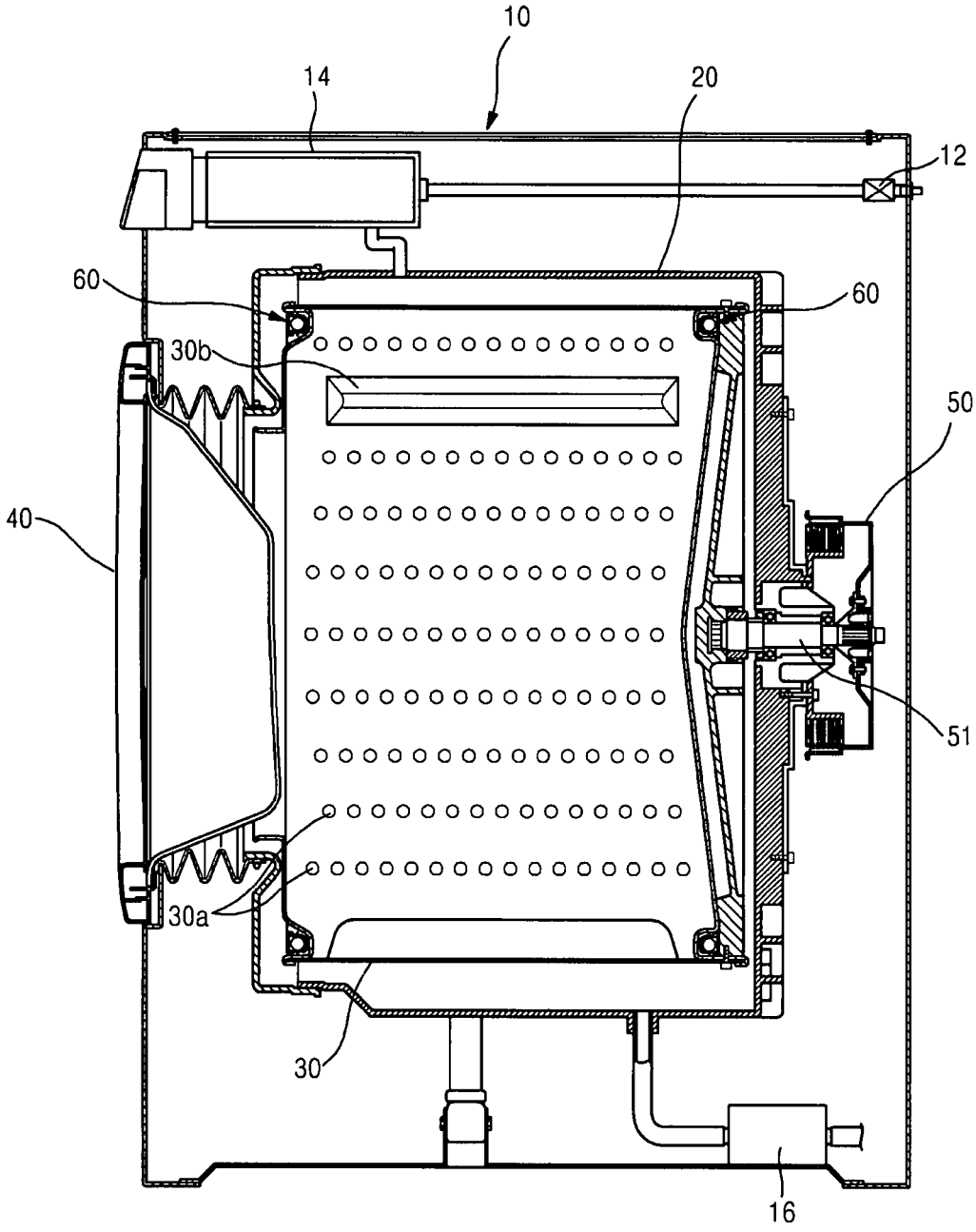
FIG. 1 is a sectional view of a washing machine having balancers in accordance with an embodiment of the present invention.

Reference will now be made in detail to the embodiment of the present invention, an example of which is illustrated in the accompanying drawings, wherein like reference numerals refer to like elements throughout. The embodiment is described below to explain the present invention by referring to the annexed drawings.

FIG. 1 is a sectional view of a washing machine having balancers in accordance with an embodiment of the present invention.

As shown in FIG. 1, a washing machine having balancers in accordance with the present invention comprises a tub 20 installed in a housing 10 forming the external appearance of the washing machine containing washing water, a drum 30 rotatably installed in the tub 20 containing laundry, and a door 40 hinged to one side of the opened front surface of the housing 10.

A water supply valve 12 supplying washing water to the tub 20 and a detergent supply device 14 supplying a detergent to the tub 20 are installed above the tub 20. Further, a drain pump 16 discharging the washing water contained in the tub 20 to the outside of the housing 10 after the washing of the laundry is completed is installed below the tub 20.

A rotary shaft 51 is extended from the rear surface of the drum 30 through the rear surface of the tub 20, and a motor 50, to which the rotary shaft 51 is connected, is installed at the outside of the rear surface of the tub 20. Accordingly, when the motor 50 is driven, the rotary shaft 51 is rotated, thus rotating the drum 30.

A plurality of dehydration holes 30*a* are formed through the circumferential surface of the drum 30. In a washing operation, the washing water contained in the tub 20 is supplied to the inside of the drum 30 through the dehydration holes 30*a* so that the laundry contained in the drum 30 can be washed with the washing water, in which the detergent dissolves, and in a dehydrating operation, the washing water is discharged to the outside of the housing 10 through the dehydration holes 30*a* and the drain pump 16.

A plurality of lifters 30*b* are disposed in the lengthwise direction in the drum 30. In the washing operation, when the drum 30 is rotated at a low speed, the lifters 30*b* lift laundry, which is wet, upwardly from the bottom of the drum 30 and then drops the laundry to the bottom, thus allowing the laundry to be effectively washed.

Accordingly, in the washing operation, the rotary shaft 51 is rotated alternately in opposite directions by the motor 50, and thus the drum 30 is rotated at a low speed, thereby washing the laundry. Further, in the dehydrating operation, the rotary shaft 51 is rotated in one direction of the motor 50, and thus the drum 30 is rotated at a high speed, thereby dehydrating the laundry.

In the dehydrating operation, when the drum 30 is rotated at a high speed, the center of gravity of the drum 30 does not coincide with the center of rotation of the drum 30, or the laundry in the drum 30 is not uniformly distributed but is clustered on a specific part. In this case, the drum 30 is eccentrically rotated on the rotary shaft 51, and cannot maintain its dynamic balance.

In order to prevent the above dynamic imbalance of the drum 30, balancers 60 stabilizing the rotation of the drum 30 are respectively installed at the front and rear ends of the drum 30, thus allowing the drum 30 to be rotated at a high speed under a condition that the center of gravity of the drum 30 coincides with the center of rotation of the drum 30.

Figure 2:
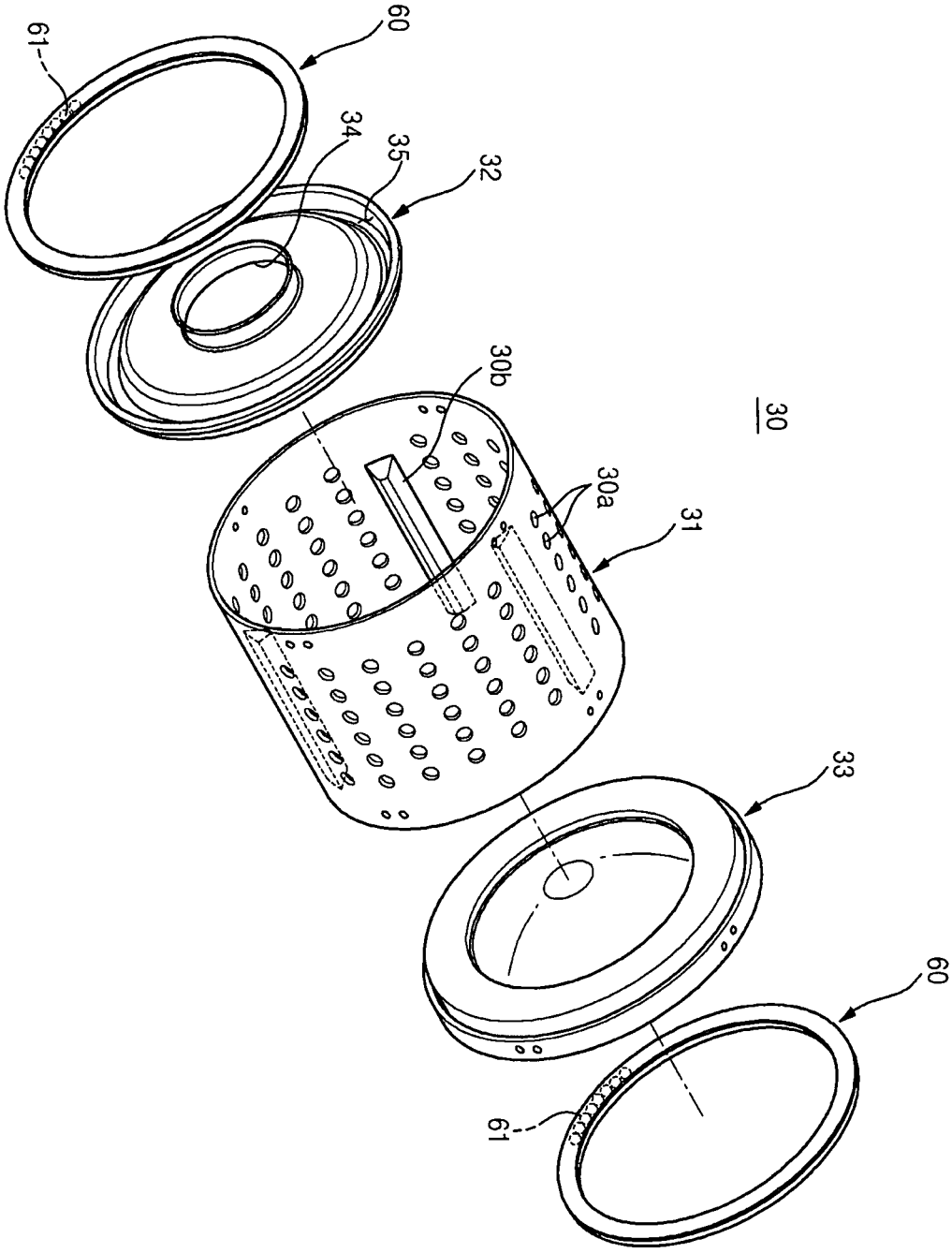
FIG. 2 is an exploded perspective view of a drum of the washing machine of the embodiment of the present invention.
Figure 3:
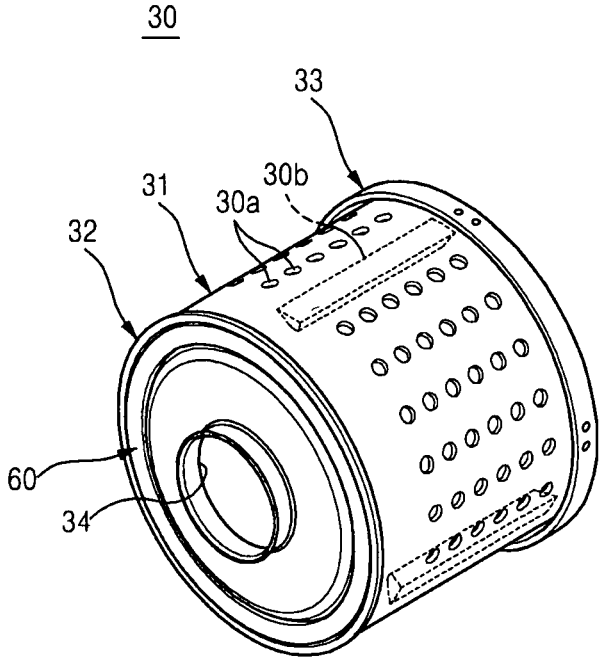
FIG. 3 is a perspective view of the drum, in an assembled state, of the washing machine of the embodiment of the present invention.

FIG. 2 is an exploded perspective view of the drum of the washing machine of the embodiment of the present invention, and FIG. 3 is a perspective view of the drum, in an assembled state, of the embodiment of the washing machine of the present invention.

As shown in FIG. 2, the drum 30 includes a cylindrical body 31, front and rear portions of which are opened, provided with the dehydration holes 30*a* and the lifters 30*b*, a front member 32 connected to the opened front portion of the body 31 and provided with an opening 34, through which laundry is put into or taken out of the body 31, and a rear member 33, to which the rotary shaft 51 rotating the drum 30 is connected, connected to the opened rear portion of the body 31.

A ring-shaped recess 35 having an approximately U-shaped section and opened forward containing the balancer 60 is formed in the edge of the front member 32, and a ring-shaped recess (not shown) having an approximately U-shaped section and opened backward for containing the balancer 60 is formed in the edge of the rear member 33.

As shown in FIG. 3, the front member 32 and the rear member 33 are inserted into the rims of the front and rear ends of the body 31, and are connected to the body 31 with screws or by other methods.

The balancers 60 are installed in the recess 35 of the front member 32 and the recess (not shown) of the rear member 33. Each of the balancers 60 includes a ring-shaped single race, and a plurality of balls 61 made of, for example, steel, which are installed in the race and have a balancing function, and a viscous oil (not shown) filling the race adjusting the moving speed of the balls 61.

The balls 61 are installed in the race such that the balls 61 can move in the circumferential direction. When the dynamic imbalance of the drum 30 occurs, the balls 61 move in the circumferential direction to a position, which is symmetrically opposite to the position of the drum 30 where the dynamic imbalance of the drum 30 occurs, thus reducing the vibration of the drum 30.

Figure 4:
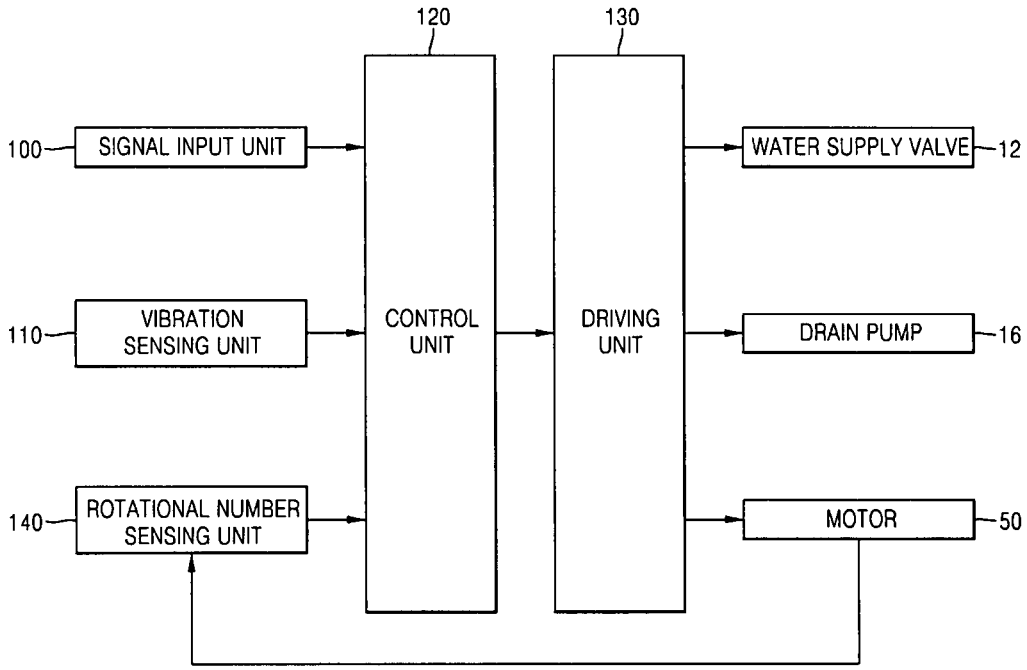
FIG. 4 is a control diagram of the embodiment of the washing machine of the present invention.

FIG. 4 is a control diagram of the washing machine of the embodiment of the present invention. As shown in FIG. 4, the washing machine of the embodiment of the present invention includes a signal input unit 100, a vibration sensing unit 110, a control unit 120, a driving unit 130, and a number sensing unit 140.

The signal input unit 100 allows a user to input operation data, such as a washing course, which is selected by the user according to the material of laundry, (for example, a delicate washing course or a standard washing course), a washing temperature, a dehydrating rpm, and the addition of a rinsing course, to the control unit 120.

The vibration sensing unit 110 senses the vibration of the tub 20, which varies while the number of rotations per minute of the motor 50 is maintained at a designated number of rotations per minute (W-RPM, approximately 160~270 rpm) before the excessive vibration of the tub 20 occurs (the number of rotations per minute of the motor 50 when the excessive vibration of the tub 20 occurs (A-RPM) is approximately 270 rpm) until the balls 61 reach a balancing position (opposite to the position where laundry (W) is partially disposed in the drum 30), in order to prevent the excessive vibration of the tub 20 before the balls 61 reach the balancing position in a dehydrating operation. Thereby, a signal waveform of a vibration frequency, as shown in FIG. 5, is obtained.

Figure 5:
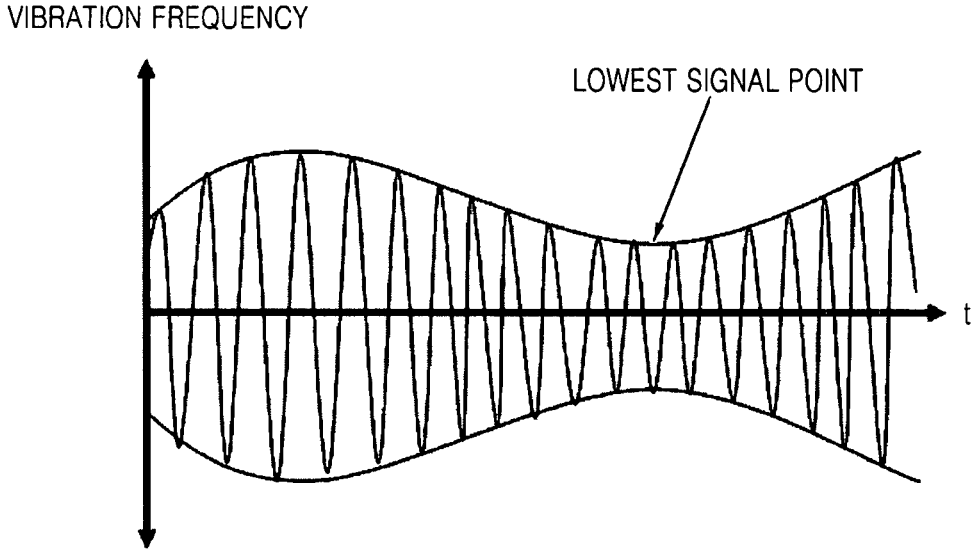
FIG. 5 is a graph illustrating a signal waveform of the vibration of a tub according to a difference of rotational speeds between the drum and balls in the washing machine of the embodiment of the present invention.
Figure 6:
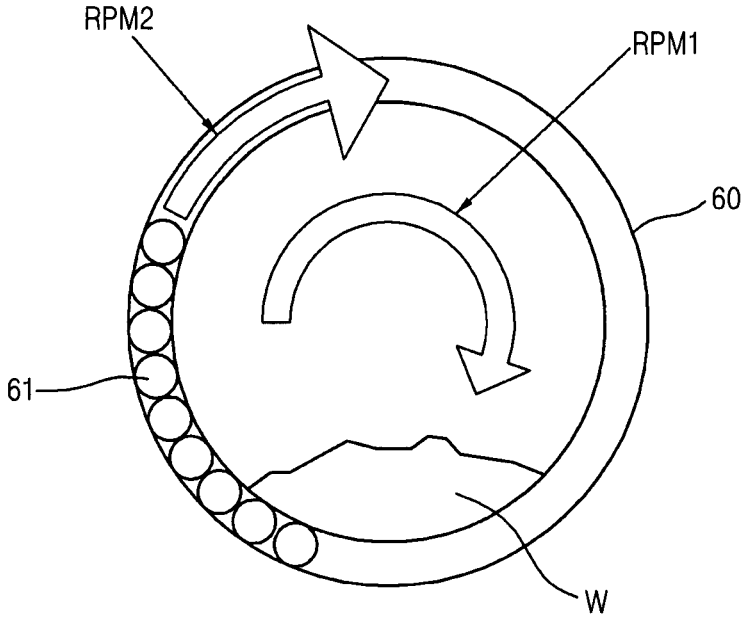
FIG. 6 is a view illustrating a difference of rotational speeds between the drum and the balls in the washing machine of the embodiment of the present invention.

The vibration frequency of FIG. 5 exhibits a signal waveform generated by modulation due to a difference between the rotational speed (RPM1) of the drum 30 and the rotational speed (RPM2) of the balls 61, as shown in FIG. 6.

The control unit 120 may be, for example, is a microcomputer, which controls the washing machine according to the operation data input from the signal input unit 100. The control unit 120 controls the motor 50 such that the number of rotations per minute of the motor 50 is maintained at a designated number of rotations per minute (W-RPM) for a designated time (a time calculated based on a time to reach a number of rotations per minute generating the excessive vibration of the tub 20 from the designated number of rotations per minute) so as to pass a point of the excessive vibration of the tub 20 in the dehydrating operation, and then to increase the number of rotations per minute of the motor 50 to rotate the drum 30 at a high speed.

The driving unit 130 drives the water supply valve 12, the drain pump 16, and the motor 50 according to driving control signals of the control unit 120.

The number sensing unit 140 senses the number of rotations per minute of the motor 50 and inputs the sensed number of rotations per minute of the motor 50 to the control unit 120 detecting the rotational speed (RPM1) of the drum 30.

Hereinafter, a method of controlling the above-described washing machine and functions and effect of the washing machine and the method of controlling the same will be described.

Figure 7:
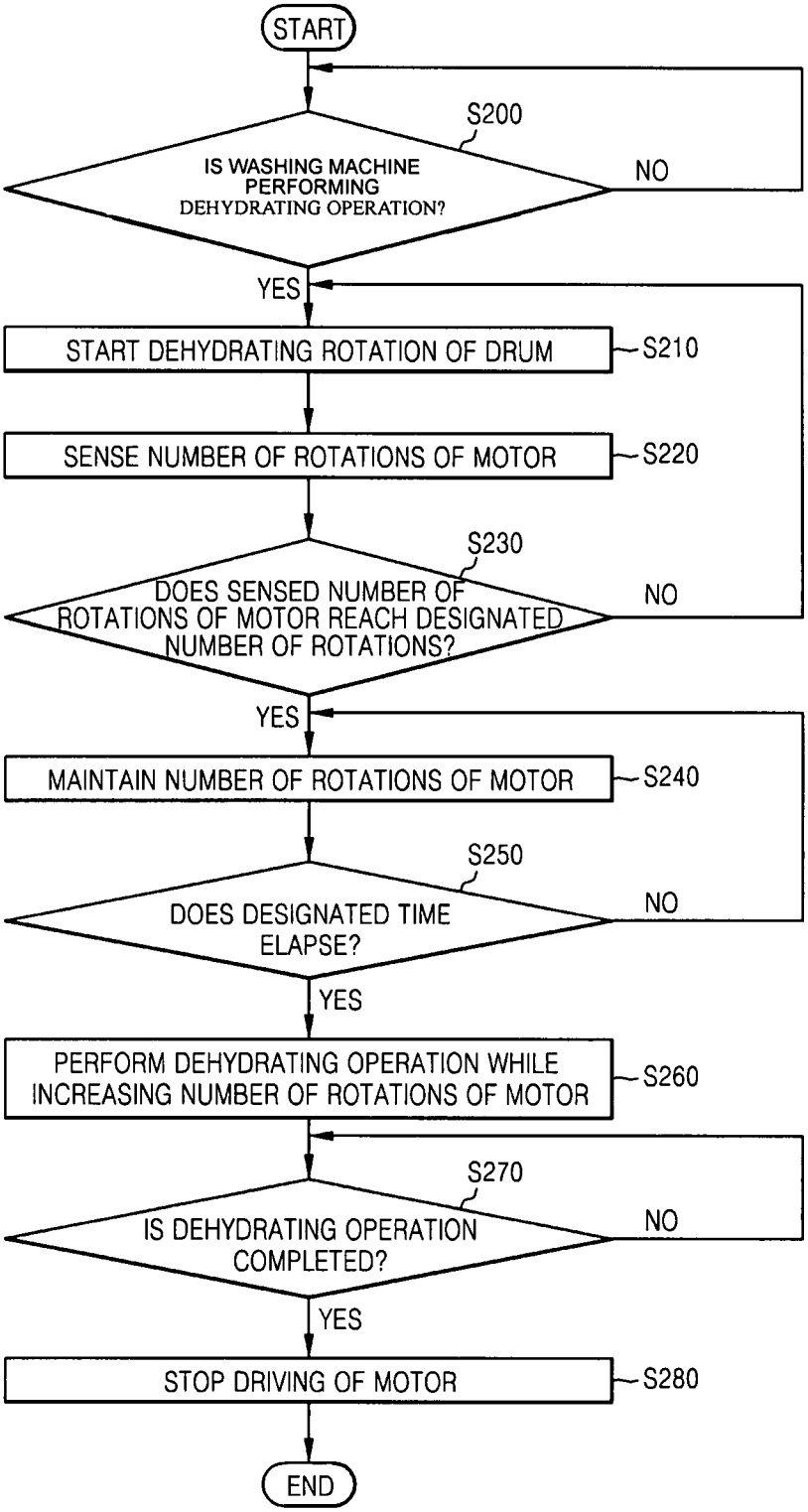
FIG. 7 is a flow chart illustrating a method of controlling a washing machine having balancers to reduce the excessive vibration of a tub in accordance with the embodiment of the present invention.

FIG. 7 is a flow chart illustrating a method of controlling a washing machine having balancers to reduce excessive vibration of a tub in accordance with the embodiment of the present invention.

First, whether or not the washing machine is performing in a dehydrating operation is determined (S200). When it is determined that the washing machine is performing in the dehydrating operation, the control unit 120 drives the motor 50 through the driving unit 130, and a dehydrating rotation of the drum 30 is started by the driving of the motor 50 (S210).

When the dehydrating rotation of the drum 30 is started by the driving of the motor 50, the rotational speed of the drum 30 is increased. In an initial rotating stage, since the viscous oil (not shown) filling the balancers 60 cannot push up the balls 61, as shown in FIG. 6, a difference between the rotational speed (RPM1) of the drum 30 and the rotational speed (RPM2) of the balls 61 occurs. Due to the above difference between the rotational speed (RPM1) of the drum 30 and the rotational speed (RPM2) of the balls 61, there is a resonance point, at which the tub 20 is excessively vibrated before the balls 61 reach the balancing position.

Accordingly, in the dehydrating operation, the number of rotations per minute of the motor 50 is maintained to the constant number of rotations per minute (W-RPM) prior to the number of rotations per minute (A-RPM) of the resonance point, i.e., the point, at which the tub 20 is excessively vibrated, until the balls 61 reach the balancing position. Thereby, the point at which the tub 20 is excessively vibrated, is passed.

In more detail, when the dehydrating rotation of the drum 30 is started, the number sensing unit 140 senses the number of rotations per minute of the motor 50, and inputs the sensed number of rotations per minute of the motor 50 to the control unit 120 (S220).

Thereafter, the control unit 120 compares the number of rotations per minute of the motor 50 sensed by the number sensing unit 140 with a designated number of rotations per minute (W-RPM), which is stored, and determines whether or not the sensed number of rotations per minute of the motor 50 reaches the designated number of rotations per minute (W-RPM) (S230).

Figure 8:
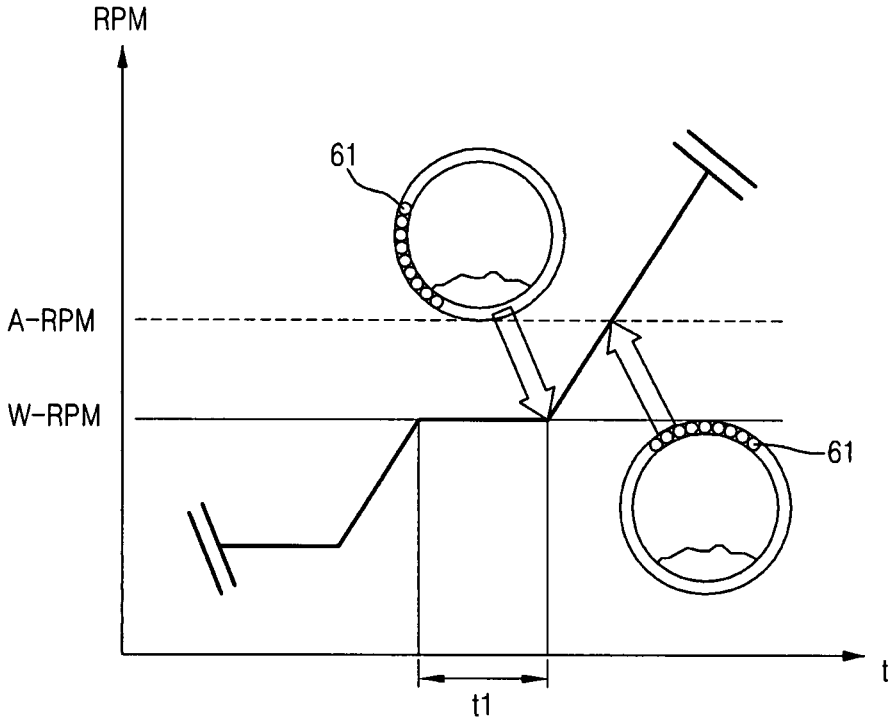
FIG. 8 is a graph illustrating control of the number of rotations of a motor to reduce the excessive vibration of the tub in the washing machine of the embodiment of the present invention.

As a result of the determination, when the sensed number of rotations per minute of the motor 50 reaches the designated number of rotations per minute (W-RPM), the number of rotations per minute of the motor 50 is maintained, as shown in FIG. 8 (S240).

FIG. 8 is a graph illustrating control of the number of rotations per minute of the motor 50 to reduce excessive vibration of the tub 20 in the washing machine of the embodiment of the present invention. The number of rotations per minute of the motor 50 is maintained at the designated number of rotations per minute (W-RPM) before the excessive vibration of the tub 20 occurs, thus waiting until the balls 61 reach the balancing position.

As shown in FIG. 8, the balls 61 reach the balancing position by maintaining the number of rotations per minute of the motor 50 at the designated number of rotations per minute (W-RPM).

While the number of rotations per minute of the motor 50 is maintained at the designated number of rotations per minute (W-RPM), the signal waveform, as shown in FIG. 5, can be obtained with a component sensing a variation of speed or vibration of the tub 20 (for example, the vibration sensing unit).

The vibration frequency of FIG. 5 exhibits a signal waveform generated by modulation due to a difference between the rotational speed (RPM1) of the drum 30 and the rotational speed (RPM2) of the balls 61, as shown in FIG. 6. In the graph of FIG. 5, the vibration of the tub 20 does not exceed a designated reference value, and the number of rotations per minute of the motor 50 in which the modulation due to a difference between the rotational speed (RPM1) of the drum 30 and the rotational speed (RPM2) of the balls 61 is easily found is set.

The control unit 120 measures a time for maintaining the number of the motor 50 at the designated number of rotations per minute (W-RPM), and determines whether or not the measured time exceeds a designated time (t1) (S250). When it is determined that the measured time exceeds the designated time (t1), the dehydrating operation is performed while increasing the number of rotations per minute of the motor 50 to a dehydrating RPM (S260).

Here, the number of rotations per minute of the motor 50 may be maintained at the designated number of rotations per minute (W-RPM) for the designated time (t1) predetermined by the control unit 120, and be increased again. Further, the control unit 120 may continuously check the signal waveform of the vibration frequency, as shown in FIG. 5, and increase the number of rotations per minute of the motor 50 before a lowermost signal point at which the vibration frequency reaches the lowermost value.

Thereafter, when the dehydrating operation is completed (S270), the driving of the motor 50 is stopped (S280).

Although the embodiment of the present invention describes the dehydrating operation for reducing the excessive vibration of the tub 20, the present invention is not limited thereto. That is, the present invention may be applied to any operation, in which the vibration of the tub 20 occurs before the balls 61 of the washing machine having the balancers 60 reach the balancing position.

As apparent from the above description, the embodiment of the present invention provides a washing machine having balancers preventing the excessive vibration of a tub before balls reach a balancing position and a method of controlling the same, in which the number of rotations per minute of a motor is maintained to a designated number of rotations per minute, before the excessive vibration of the tub occurs, for a designated time so as to pass a point, at which the excessive vibration of the tub occurs, each of the balancers does employs a single race, instead of a multi-race, so as to reduce production costs, and the excessive vibration of the tub is prevented by a control operation, instead of a probability, so as to effectively reduce the excessive vibration of the tub.

Although embodiment of the invention has been shown and described, it would be appreciated by those skilled in the art that changes may be made in this embodiment without departing from the principles and spirit of the invention, the scope of which is defined in the claims and their equivalents.

What is claimed is:

1. A method of controlling a drum type washing machine having a tub, a drum rotatably installed inside the tub, a motor rotating the drum, and a balancer installed on at least one of a front end and a rear end of the drum, the method comprising:

sensing a rotational speed of a motor by a number sensing unit in a dehydration operation according to drive of the motor;

determining whether or not the sensed rotational speed of the motor reaches a designated rotational speed by comparing the sensed rotational speed of the motor with the designated rotational speed;

positioning balls in the balancer in a balancing position by maintaining the rotational speed of the motor at the designated rotational speed when it is determined that the sensed rotational speed of the motor reaches the designated rotational speed;

measuring a time for maintaining the rotational speed of the motor at the designated rotational speed, and determining whether or not the measured time exceeds a designated time (t1) that is calculated based on a time taken to reach a rotational speed of generating excessive vibration of the tub from the designated rotation speed;

sensing, by a vibration sensing unit, vibration of the tub generated due to a difference between a rotational speed of the drum and a rotational speed of the balls when it is determined that the measured time exceeds the designated time (t1); and increasing the rotational speed of the motor to a dehydrating rpm before a lowermost signal point at which a vibration frequency of the sensed vibration of the tub reaches a lowermost value, wherein in the maintaining the rotational speed of the motor at the designated rotational speed, the rotation speed of the motor is maintained at the designated rotation speed positioning the balls in the balancing position so as to pass a point at which the excessive vibration of the tub is generated in the dehydration operation, the designated rotation speed being prior to the point.

2. The method according to claim 1, wherein the designated rotational speed is lower than a rotational speed generating an excessive vibration of the tub in a dehydrating operation.

3. The method according to claim 2, wherein the rotational speed generating the excessive vibration of the tub is the rotational speed of the motor at a point at which the tub is excessively vibrated due to a difference of rotational speeds between the drum and the balls before the balls reach a balancing position.

4. A washing machine, comprising:

a tub;

a drum rotatably installed inside the tub;

a motor rotating the drum;

a plurality of balancers, each of the plurality of balancers installed on at least one of a front end and a rear end of the drum, and having balls therein;

a number sensing unit to sense the number of rotations of the motor per minute;

a vibration sensing unit having a vibration sensor to sense the vibration of the tub generated due to a difference between a rotational speed of the drum and a rotational speed of the balls inside the balancers; and a control unit, in a dehydration operation according to drive of the motor, comparing the sensed number of rotations of the motor per minute with a designated rotational speed per minute, and controlling the motor such that the number of rotations of the motor is maintained at the designated rotational speed when the sensed rotational speed of the motor reaches the designated rotational speed, and increasing the number of rotations of the motor per minute to a dehydrating rpm performing the dehydrating operation before a lowermost signal point at which a vibration frequency of the sensed vibration of the tub reaches a lowermost value, when it is determined that the measured time exceeds a designated time (t1) that is calculated based on a time taken to reach a rotational speed of generating excessive vibration of the tub from the designated rotation speed by measuring a time for maintaining the number of rotations per minute of the motor at the designated number of rotations per minute, wherein the designated number of rotations is predetermined to be lower than a number of rotations generating excessive vibration of the tub in a dehydrating operation of the washing machine, by the control unit.

5. The washing machine according to claim 4, wherein the rotational speed generating the excessive vibration of the tub is the rotational speed of the motor at a point at which the tub is excessively vibrated due to a difference of rotational speeds between the drum and the balls before the balls reach a balancing position.

6. The washing machine according to claim 5, wherein the control unit controls the motor such that the number of rotations per minute of the motor is maintained at the designated number of rotations prior to a point at which the tub is excessively vibrated, generated in the dehydrating operation of the washing machine so as to pass the point.

* * * * *